US005292038A

United States Patent [19]

Seney

[11] Patent Number: 5,292,038

[45] Date of Patent: Mar. 8, 1994

[54] PRESSURIZED BOTTLE DISPENSING ASSEMBLY

[76] Inventor: John S. Seney, 57 Marlin Dr., Sugarloaf Shores, Fla. 33044

[21] Appl. No.: 4,133

[22] Filed: Jan. 13, 1993

[51] Int. Cl.[5] ..... B65D 83/20

[52] U.S. Cl. ..... 222/402.13; 222/402.25; 222/464; 222/509; 222/525

[58] Field of Search ..... 222/402.1, 402.13, 402.25, 222/405, 394, 501, 505, 507, 509, 522, 525, 526, 559, 464

[56] References Cited

U.S. PATENT DOCUMENTS

| | | | |
|---|---|---|---|
| 2,646,192 | 7/1953 | Gronemeyer | 222/402.25 X |
| 2,779,514 | 1/1957 | Kebel | 222/402.25 X |
| 2,781,152 | 2/1957 | Van Slyke | 222/402.25 X |
| 2,887,272 | 5/1959 | Rosenthal | 222/402.25 X |
| 3,128,915 | 4/1964 | Matter | 222/501 X |
| 3,134,505 | 5/1964 | Moderno | 222/402.25 X |
| 3,474,940 | 10/1969 | Hogg | 222/402.25 X |
| 3,682,355 | 8/1972 | Lo | 222/402.25 X |
| 4,138,092 | 2/1979 | Apellaniz | 222/509 X |
| 4,722,463 | 2/1988 | Anderson | 222/509 X |
| 4,742,942 | 5/1980 | Dokos et al. | 222/501 |

*Primary Examiner*—Andres Kashnikow
*Assistant Examiner*—Kenneth DeRosa
*Attorney, Agent, or Firm*—Aquilino & Welsh

[57] ABSTRACT

A carbonated beverage dispensing device for suppressing the loss of carbonation from a beverage container which normally occurs during the repeated opening and closing of a container. The dispensing device provides for a convenient, efficient and sanitary way to dispense carbonated beverages especially from large containers. By placement of a spring-type valve mechanism in a downward spout of the dispenser the problems associated with liquid pooling and bacteria retention from prior art dispensers are eliminated. The present invention allows for dispensing without lifting or removal of the container allowing for ease of use through a unique siphoning, sealing technique and valve actuating assembly.

9 Claims, 2 Drawing Sheets

PRESSURIZED BOTTLE DISPENSING ASSEMBLY

BACKGROUND OF THE INVENTION

A universal problem in dispensing carbonated fluids from commercial containers, large containers in particular, is that the sealing cap must be removed from the container each time the fluid is dispensed, thereby permitting carbon dioxide ($CO_2$) to escape. Frequently, by the time the container is half empty, the remaining fluid has lost enough carbonization to render it "flat." When this occurs, the fluid becomes undesirable to consume and is discarded along with the container. This essentially nullifies the savings of buying a large container. Further, when these containers are discarded prematurely, they contribute to this country's waste disposal problem. It has been estimated that if all the bottled carbonated beverages were sold in 2 liter sized bottles, bottling, packaging and distribution costs could be reduced by an estimated 30% or more.

In the prior art, attempts to provide a pressurized bottle dispenser have been limited by the properties of the dispensed liquid. In the prior art typical dispensers place the flow control valve mechanism in the upward flow section of the dispenser device. A stagnation problem and the enhancement to draw insects occurs when fluid collects in crevices exterior of the valve assembly where it can stagnate and permit bacteria to grow. When the next discharge of fluid occurs, this residual amount of fluid, after 5. having stagnated and collected bacteria, is discharged along with the clean fluid in the bottle into the drinking container and consumed by the unsuspecting user. The prior art valve systems further fail to account for potential soft debris that may be present in the dispensed fluid. Without a proper sealing technique, soft debris present in the liquid may interfere with the positive sealing action of the valve. This precludes a liquid tight seal from being effected and allows $CO_2$ and/or fluid to escape.

The most common form of dispensers found in the prior art require that the container be tipped to commence dispensing. Because of the relative weight and bulk size of most large carbonated beverage containers dispensing by either lifting and/or tipping the container becomes a difficult task and may result in less than accurate pouring. A need also exists, as per above, to make the pouring process readily accessible to those incapable of lifting and/or handling such heavy containers.

The bottle seals used in the prior art are removable, and as such, have the propensity to remain stuck to the bottle top when a dispensing device is removed. When this happens, a typical prior art siphon or hollow tube remains with the seal stuck to the bottle neck top, and is exposed to atmospheric pressure permitting the remaining carbonated residual fluid to discharge uncontrollably through the hollow tube, thereby spilling fluid and causing a considerable mess.

SUMMARY OF THE INVENTION

The overall object of the present invention is to provide a dispensing mechanism for carbonated beverage containers that is convenient, sanitary and efficient.

Specifically, the first object of the invention is to ensure all fluid will be dispensed without subsequent dripping or pooling of fluid which encourages bacteria growth, fluid stagnation and attracts insects.

Another object of the invention is to provide the capability for complete disassembly to permit cleaning and valve core replacement/cleaning.

Another object of the invention is to increase internal dispenser pressure and enhance fluid discharge flow rate by increasing the fluid surface area and physically present a surface attractive to the weakly bonded $CO_2$ gas molecules dissolved in the carbonated fluid, thereby increasing the gas pressure inside the container.

Another object of the invention is to permit fluid dispensing without having to tip the container to achieve fluid flow, therefore enabling a user to dispense fluid with the use of only one hand when the fluid container is held in place as in a refrigerator door shelf.

Another object of the invention is to provide a positive seal even in the presence of soft debris that may be present in the dispensed fluid.

Another object of the invention is to incorporate a nonremovable seal for airtight sealing between the dispensing assembly and the fluid container, preventing accidental discharge of fluid when the dispensing assembly is removed.

The objects of the invention are achieved by a carbonated beverage dispenser having a valve located in the downward end of a dispensing spout. Because the valve of the present invention is mounted in the downward pointing spout, all the fluid is discharged and no residual dripping from the spout occurs thereby eliminating pooling of liquid and retention of bacteria. Further, the valve core is removable for easy cleaning or to permit a new valve core to be installed.

The invention employs a non-wettable siphon tube made of the material polyethylene or similar materials possessing non-wettable surface characteristics. Thus, when the hose is inserted into the carbonated fluid, the fluid releases $CO_2$ which helps build up pressure in the bottle, thereby enhancing fluid flow, but not noticeably affecting effervescence. This increased internal pressure is achieved by increasing the fluid surface area and physically presents a surface attractive to the weakly bonded $CO_2$ gas molecules dissolved in the carbonated fluid, thereby increasing the gas pressure inside the container. The bottom of the non-wettable tube is notched to ensure ready fluid access to the inner tube. The assembly further contains a non-removable "O-Ring" seal which prevents $CO_2$ from escaping at the assembly/bottle neck sealing point.

Applicant's invention allows the container to be held in place, as in the door shelf in a modern refrigerator, the bottle does not have to be removed to discharge the fluid. Fluid may be dispensed by the use of only one hand that holds the drinking container by compressing a valve actuator by contact with the drinking container. The present invention provides the capability of not removing the dispensing container by employing an effervescent enhancing device in the form of the above described siphon tube possessing non-wettable interior and exterior surfaces, which increases $CO_2$ pressure.

The present invention spout employs a single knife edge sealing with a resilient opposite member such as neoprene. This configuration provides a positive seal even in the presence of soft debris. The sharp, knife-like circular valve core valve body seal flange is pressed hard against the soft resilient seal in the valve core plunger cap when the valve is closed. The hard mating pressure between these two mating surfaces provides a knife-like cutting action which has the ability to sever soft debris that may lodge on these surfaces when fluid is flowing. Other similar dispensing devices have a large sealing surface which does not provide for this feature. Without this ability to sever the soft debris, the valve remains slightly ajar, thereby permitting fluid to slowly leak out the valve and bleed down the $CO_2$ pressure in the container, thereby nullifying the advantage of the objective of the device.

Other bottle neck seals such as that employed in the prior art have the distinct disadvantage of becoming inadvertently detached from the device. As such, the soft wide seal which also holds the siphon tube has the propensity to remain attached to the top of the container when the dispensing device is removed. If pressurized fluid remains in the container, it will flow out the tube uncontrollably. The container seal of the instant invention is an O-Ring held in place by means of an annular groove which prevents the O-Ring from inadvertently separating from the device as it is removed. The O-Ring may be removed, however, for cleaning.

These and other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
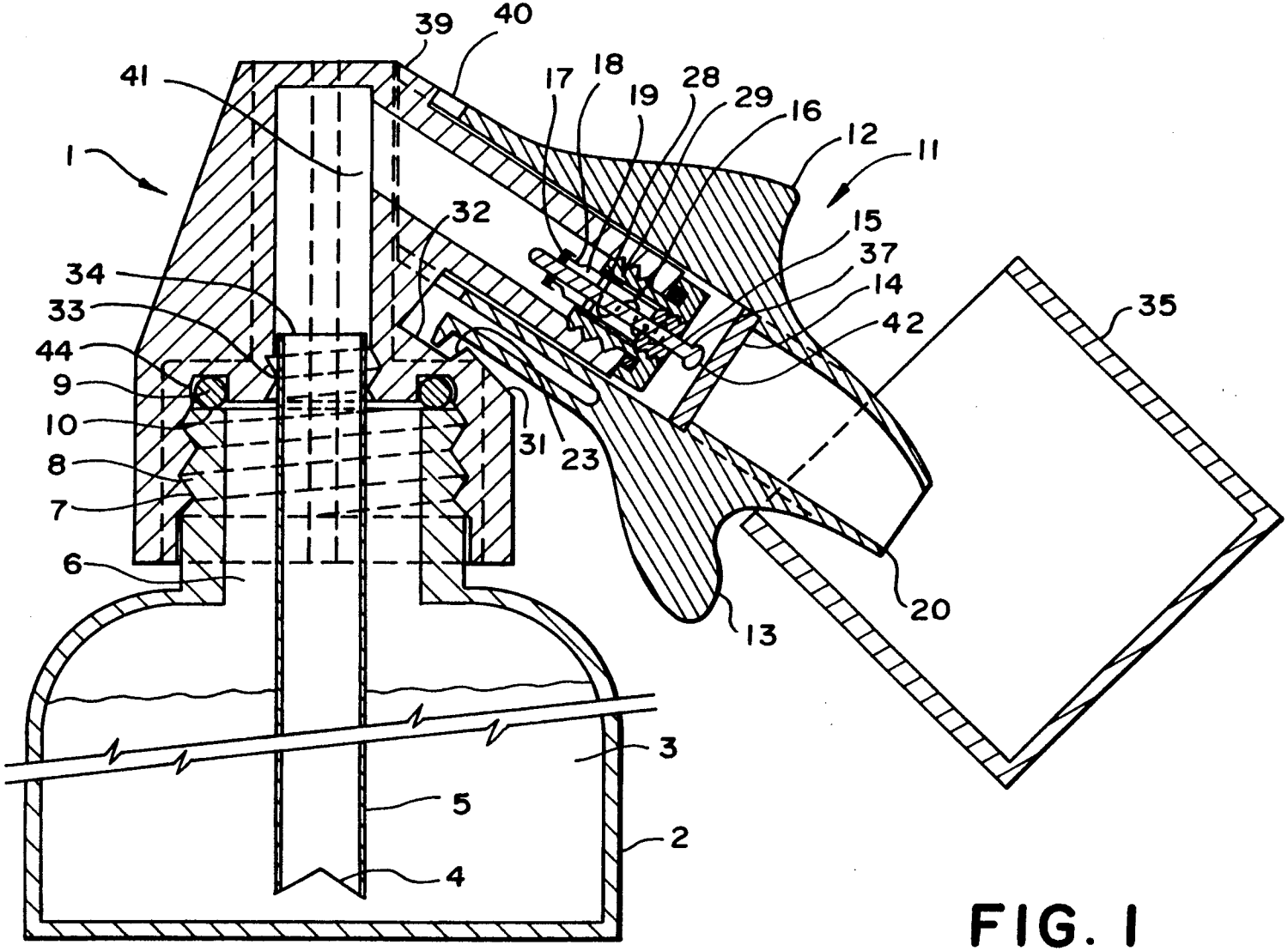
FIG. 1 illustrates a cutaway half section of the entire dispenser assembly attached to a container having a threaded neck and a hand-held drink container (glass) whose rim is shown in contact with the dispenser assembly.
Figure 2:
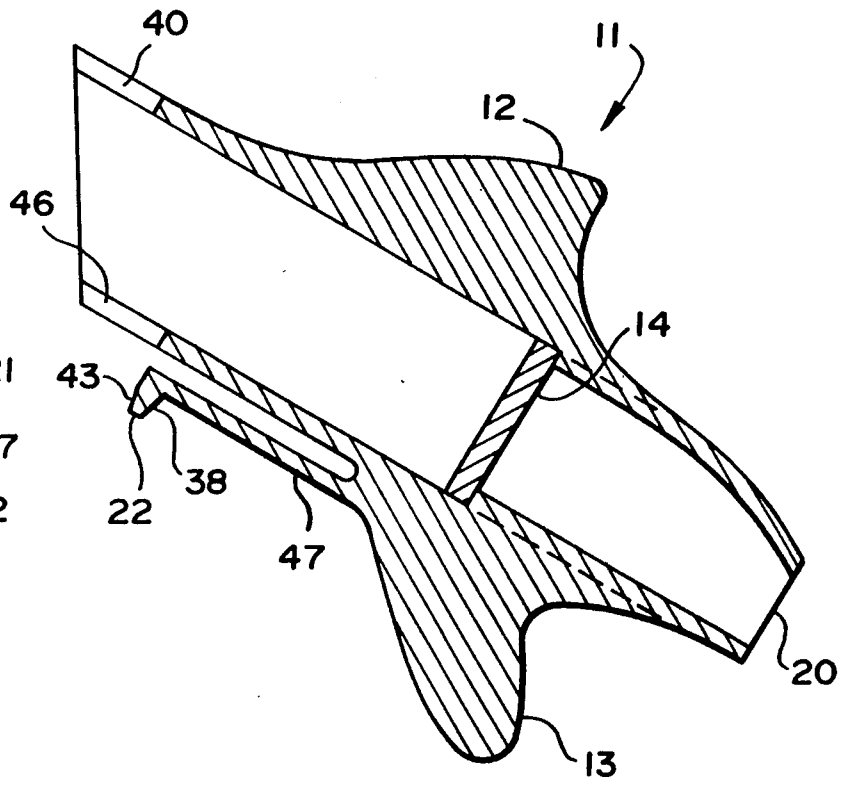
FIG. 2 illustrates a cutaway half section showing the valve actuator/discharge assembly.
Figure 3:
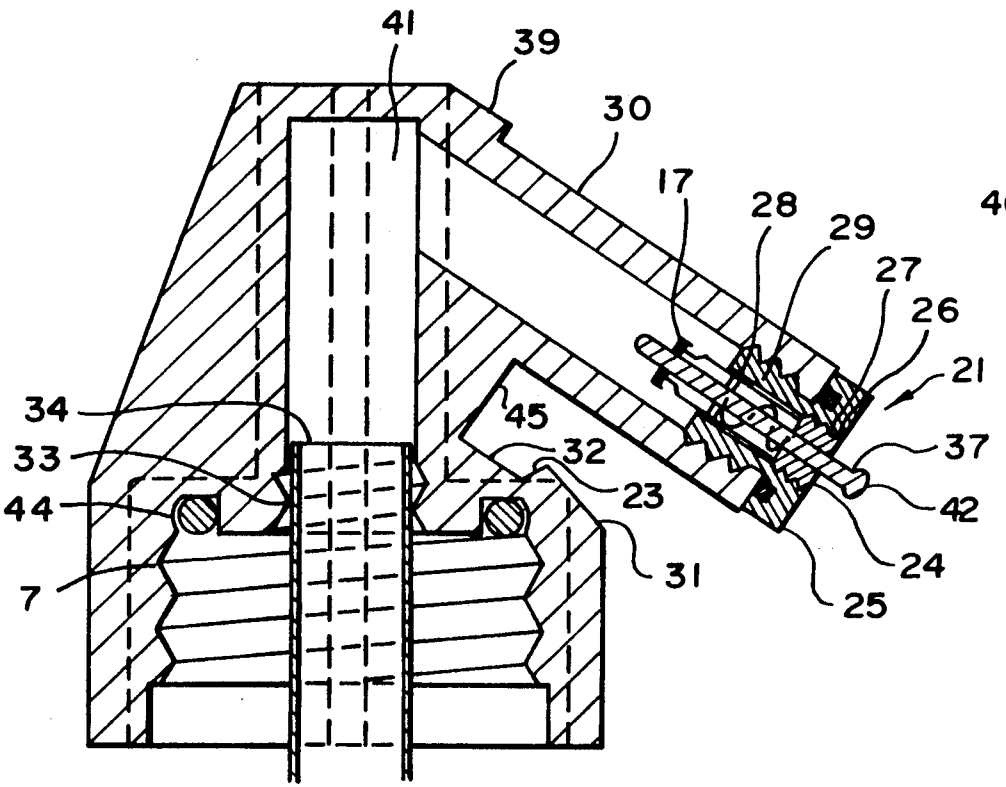
FIG. 3 illustrates a cutaway half section showing the dispenser assembly with the valve actuator/discharge port assembly removed.

Referring to the drawings, FIG. 1 shows the entire dispensing system 1. The system is installed on a typical carbonated beverage container 2 which contains a carbonated beverage 3. The manufacturer's sealed cap is removed from the carbonated beverage container 2. The notched (bottom) end 4 of a non-wettable siphon tube 5 is inserted into the container neck opening 6 and pushed down until the internal threads 7 in dispensing system 1 contact the external neck threads 8 of fluid container 2. Dispensing assembly 1 or beverage container 2 is rotated to engage both sets of threads and continues to be rotated until an airtight seal is achieved between "O-Ring" seal 9 and fluid container neck top sealing face 10. The most commonly used size for a carbonated beverage container is a 28 mm threaded neck, although the invention should not be limited to this size. The device can be modified to be of any desired size. "O-Ring" seal 9 is held in place by means of annular groove 44 which prevents accidental removal or loss. To dispense fluid, the valve actuator/discharge port is moved aft along its longitudinal axis by either the upper or lower valve actuator/discharge port actuating extension 12 or 13 to its physical stop or any position in between, depending upon the discharge flow rate desired. This is normally accomplished by using one's fingers to pull aft on the upper or lower valve actuator/discharge port assembly actuating extensions 12 or 13. One hand operation is achieved by pushing the rim of drink container 35 against lower valve actuator/discharge port actuating extension 13 while the container 2 is rendered immobile as when stored in the refrigerator inside door shelf. As valve actuator/discharge port assembly 11 is moved aft, actuating pin 14 contacts the front face of valve core plunger pin head 42, and as it continues to be moved aft, lifts valve core plunger cap seal 17 off valve core body seal flange 18. The valve core employed in this device is similar to the Schrader standard bore valve core, which is inexpensive and used in millions of applications throughout the world. The specific valve should not be limited to the above description. A functionally equivalent valve can be substituted as long as there is no degradation of performance.

Physical stop is reached when the inside face of valve core plunger pin head 37 contacts valve core bridge face 36. Valve actuator/discharge port assembly surrounds valve holder spout 30 and slides parallel to its longitudinal axis. Its aft movement is restrained by the physical stop as described above. Its forward movement is restricted by the physical interference between the inside face 38 of retaining catch 22 and disassembly ramp 23. It is restrained from rotating around the longitudinal axis by upper assembly flange 39 and lower assembly flange 45 fitting inside upper valve actuator/discharge nozzle assembly slot 40 and lower slot 46. During dispensing operation, upper flange 39 and lower flange 45 slide inside upper slot 40 and lower slot 46 as the valve actuator/dispensing port is moved forward and aft. Pushing or pulling back on either extension causes the valve actuating pin 14 to contact valve core plunger 15. As valve actuating pin 14 is moved further aft, the closing force of valve core spring 16 and internal bottle gas pressure is overcome and valve core plunger cap seal 17 is separated from valve core body seal flange 18. When this occurs, an opening exists between plunger cap seal 17 and seal flange 18. The pressure in the carbonated fluid container forces fluid 3 up through non-wettable siphon tube 5 because of the pressure differential between higher internal container pressure and lower atmospheric pressure. The pressurized fluid 3 flows into pressurized bottle dispensing assembly passage 41, into valve core internal passage 19 and out discharge port 20. Fluid flow is stopped by releasing pressure on either valve actuator/discharge port actuating extension 12 or 13. Internal gas pressure and the tension of valve core plunger spring 16 act together to close valve core plunger cap seal 17 against valve core body seal flange 17 thereby stopping fluid flow and maintaining pressure within carbonated fluid container 2. The combination of having the valve core assembly 21 located in the downward pointing nozzle itself, and the lack of fluid entrapment pockets exposed to the atmosphere, ensures that all the fluid will flow into the container and no fluid will be left to stagnate or drip after dispensing is complete.

This device can be disassembled for cleaning in a few short steps. Valve actuator/discharge port assembly 11 is removed by pulling it along its longitudinal axis away from dispensing assembly Inside face 38 of retaining latch 22 slides up disassembly ramp 23 against the spring pressure caused by bending the latch's thin support member 47 anchored at the bottom of the valve actuator/discharge port assembly 11. Valve core assembly 21 is removed by rotating valve core bridge 24 counter-clockwise until valve core assembly 21 is free from the metal valve core retainer insert 25. Non-wettable hose 5 is removed by rotating it counter-clockwise to disengage it from engagement threads 33. A clear passage now exists through the pressurized bottle dispensing assembly 1 to permit a small brush or other cleaning mechanism to be employed to clean the internal passage of the assembly. The entire assembly may be sterilized by immersion in chemical solutions similar to those used in the milk industry for cleaning milk transport systems or by other known, equivalent conventional cleaning methods.

Reassembly is accomplished by threading valve core assembly 21 body threads 26 into metal valve core retainer inert threads 27 and screwing valve core assembly 21 in until an airtight seal is achieved between valve core external body seal 28 and metal valve core retainer insert tapered seal wall 29. Valve actuator/discharge port assembly 11 is pushed back over valve holder spout 30 until aft face 43 of retaining hook 22 slides up assembly ramp 31 and falls into groove 32. Retaining latch 22 now provides the forward stop for valve actuator/discharge port assembly 11. The square end 34 of non-wettable hose 5 is threaded clockwise into engagement threads 33 until it is firmly attached and seated.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A carbonated fluid dispensing device comprising:

an elongated non-wettable siphon tube to be inserted into a carbonated beverage container;

a screw-type cap to replace an original screw cap of said carbonated beverage container;

said screw-type cap having a central opening through which an upper end of said elongated tube is fed;

a dispensing head having said screw-type cap and said elongated tube operatively connected thereto;

an o-ring for sealing said screw-type cap to said dispensing head;

said dispensing head having a substantially continuous unitary flow path formed of an upward flow section and a downward flow section and further comprising:

a removable valve assembly located in said downward flow section of said dispensing head;

said removable valve assembly having a reciprocating actuating mechanism;

a removable valve actuator/discharge assembly operatively connected to said downward flow section of said dispensing head and which reciprocates longitudinally along the length of said downward flow section; and, wherein an upward movement of said removable valve actuator/discharge assembly engages said reciprocating actuating mechanism opening said removable valve assembly allowing a continuous flow of carbonated liquid up through said elongated tube into said upward flow section and down through said downward flow section through said valve assembly and said removable valve actuator/discharge assembly.

2. A carbonated fluid dispensing device as per claim 1, wherein said removable valve actuator/discharge assembly includes an ergonomically shaped finger grip.

3. A carbonated fluid dispensing device as per claim 1, wherein said removable valve actuator/discharge assembly includes a grip formed of two offset gripping members disposed at an angle of approximately 45 degrees to the longitudinal axis of said actuator/discharge assembly.

4. A carbonated fluid dispensing device as per claim 1, wherein said elongated non-wettable siphon tube, when introduced into the beverage container, facilitates the release of carbonation which increases internal pressure of the container and results in an increased fluid flow through the tube.

5. A carbonated fluid dispensing device as per claim 1, wherein said elongated non-wettable siphon tube is made of plastic with non-wettable surface characteristics.

6. A carbonated fluid dispensing device as per claim 1, wherein said elongated non-wettable siphon tube is made of polyethylene.

7. A carbonated fluid dispensing device as per claim 1, wherein said o-ring is located in a annular groove and has a round cross-sectional area.

8. A carbonated fluid dispensing device as per claim 1, further including a knife-like circular valve core body seal flange.

9. A carbonated fluid dispensing device as per claim 8, wherein said knife-like circular valve core body seal flange severs soft debris which may be present in the carbonated beverage.

* * * * *